US012013179B2

(12) United States Patent
Halcrow

(10) Patent No.: US 12,013,179 B2
(45) Date of Patent: Jun. 18, 2024

(54) METHOD OF COOLING BOIL OFF GAS AND AN APPARATUS THEREFOR

(71) Applicant: LGE IP Management Company Limited, Dunfermline (GB)

(72) Inventor: Martin Halcrow, Edinburgh Midlothian (GB)

(73) Assignee: LGE IP Management Company Limited, Dunfermline (GB)

( * ) Notice: Subject to any disclaimer, the term of this patent is extended or adjusted under 35 U.S.C. 154(b) by 351 days.

(21) Appl. No.: 17/598,345

(22) PCT Filed: Mar. 25, 2020

(86) PCT No.: PCT/GB2020/050787
§ 371 (c)(1),
(2) Date: Sep. 27, 2021

(87) PCT Pub. No.: WO2020/193971
PCT Pub. Date: Oct. 1, 2020

(65) Prior Publication Data

US 2022/0187014 A1 Jun. 16, 2022

(30) Foreign Application Priority Data

Mar. 27, 2019 (GB) ..... 1904220
Aug. 26, 2019 (GB) ..... 1912222

(51) Int. Cl.

| | |
|---|---|
| ***F25J 1/00*** | (2006.01) |
| ***B63B 25/14*** | (2006.01) |
| ***B63B 35/28*** | (2006.01) |
| ***F25J 1/02*** | (2006.01) |

(52) U.S. Cl.
CPC ..... *F25J 1/0277* (2013.01); *B63B 25/14* (2013.01); *B63B 35/28* (2013.01); *F25J 1/0025* (2013.01);

(Continued)

(58) Field of Classification Search
CPC ..... F25J 1/0025; F25J 1/0277; F17C 2270/0105; F17C 2265/034; F17C 2265/038; F17C 2265/066
See application file for complete search history.

(56) References Cited

U.S. PATENT DOCUMENTS

| | | | |
|---|---|---|---|
| 3,729,945 | A | 5/1973 | Linnett |
| 3,919,852 | A | 11/1975 | Jones |
| 4,727,723 | A | 3/1988 | Durr |

FOREIGN PATENT DOCUMENTS

| | | | |
|---|---|---|---|
| CN | 101915494 | A | 12/2010 |
| DE | 1915218 | A1 | 10/1970 |

(Continued)

OTHER PUBLICATIONS

Wenzel L A: "LNG Peakshaving Plants—A Comparison of Cycles", a Collection of Invited Papers and Contributed Papers Presented at National Technical Meetings During 1973 and 1974; 1973 Cryogenic Engineering Conference, Georgia Institute of Technology, Atlanta, Georgia, Aug. 8-10, 1973; ISBN 0-306-38020-4; IN, vol. 20, (Jan. 1, 1975).

(Continued)

*Primary Examiner* — Eric S Ruppert
(74) *Attorney, Agent, or Firm* — Flaster Greenberg, PC

(57) ABSTRACT

A method of cooling a boil off gas stream from a liquefied cargo (50*a*) in a floating transportation vessel is described. The method comprises:

compressing a boil off gas stream in two or more stages of compression to provide a compressed BOG discharge stream;

cooling the compressed BOG discharge stream against one or more first coolant streams to provide a first cooled compressed BOG stream;

cooling the first cooled compressed BOG stream against at least one second coolant stream to provide a second cooled compressed BOG stream;

(Continued)

providing a vessel fuel stream from the liquefied cargo;

using the vessel fuel stream as a coolant stream to cool either the compressed BOG discharge stream, or the first cooled compressed BOG stream, or both said streams.

19 Claims, 3 Drawing Sheets

(52) U.S. Cl.
CPC ..... *F25J 1/0045* (2013.01); *F25J 1/0052* (2013.01); *F25J 1/0087* (2013.01); *F25J 1/0208* (2013.01); *F25J 1/023* (2013.01); *F25J 1/0274* (2013.01); *F25J 2230/04* (2013.01); *F25J 2235/60* (2013.01); *F25J 2270/90* (2013.01)

(56) References Cited

FOREIGN PATENT DOCUMENTS

| | | | | |
|---|---|---|---|---|
| DE | 19717126 | A1 | | 8/1998 |
| DE | 102013010414 | B4 | | 5/2016 |
| EP | 2746707 | A1 | | 6/2014 |
| EP | 3372484 | A1 | | 9/2018 |
| GB | 2069119 | A | | 8/1981 |
| JP | S57131972 | A | | 8/1982 |
| KR | 20080081436 | A | | 9/2008 |
| KR | 101310025 | B1 | | 9/2013 |
| KR | 101334002 | B1 | * | 11/2013 |
| KR | 20160147377 | A | | 12/2016 |
| KR | 101763696 | B1 | * | 8/2017 |
| WO | 9622221 | A | | 7/1996 |
| WO | 2010093400 | A1 | | 8/2010 |
| WO | 2012143699 | A1 | | 10/2012 |
| WO | 2012165967 | A1 | | 12/2012 |
| WO | 2016027098 | A1 | | 2/2016 |
| WO | WO-2016027098 | A1 | * | 2/2016 ..... F17C 13/004 |

OTHER PUBLICATIONS

International Search Report and Written Opinion for PCT/GB2020/050787, mailed Jul. 28, 2020.

Machine Translation of CN101915494 (as previsously submitted).

Machine Translation of KR20160147377 (as previsously submitted).

* cited by examiner

METHOD OF COOLING BOIL OFF GAS AND AN APPARATUS THEREFOR

FIELD OF THE INVENTION

The present invention relates to a method for the cooling, particularly the re-liquefaction, of a boil off gas (BOG) from a liquefied cargo on a floating transportation vessel, and an apparatus therefor.

BACKGROUND

Floating transportation vessels, such as liquefied gas carriers and barges, are capable of transporting a variety of cargoes in the liquefied state. In the present context, these liquefied cargoes have boiling points of greater than −110° C. when measured at 1 atmosphere, and include but are not limited to: ethane, liquefied petroleum gas, liquefied petrochemical gasses such as propylene and ethylene, and liquefied ammonia.

Liquefied petroleum gas is a useful fuel source, such as for heating appliances and vehicles, as well as being a source of hydrocarbon compounds. LPG comprises one or more of propane, n-butane and i-butane, and optionally one or more other hydrocarbons such as propylene, butylenes and ethane. Petroleum gases can be stored and transported over long distances more readily as a liquid than in gaseous form because they occupy a smaller volume and may not need to be stored at high pressures. Such LPG can be stored at atmospheric pressure if maintained at or below its boiling temperature, such as at −42° C. or below, being the boiling point of the propane component. Alternatively, LPG may be stored at higher temperatures if it is pressurized above atmospheric pressure.

Petrochemical gases such as ethylene and propylene may be present in, or can be synthesized from, petroleum gas or other hydrocarbons. It is often desirable to liquefy petrochemical gases in a liquefaction facility at or near their place of separation or manufacture for similar reasons to the petroleum gases. Liquefied petrochemical gases can be stored at atmospheric pressure if maintained at or below their boiling temperature, such as at −104° C. or below, for ethylene. Alternatively, liquefied petrochemical gases may be stored at higher temperatures if they are pressurized above atmospheric pressure.

The long distance transportation of a liquefied cargo having a boiling point of greater than −110° C. when measured at 1 atmosphere may be carried out in a suitable liquefied gas carrier, such as an ocean-going tanker having one or more storage tanks to hold the liquefied cargo. These storage tanks may be insulated and/or pressurized tanks. During the loading of the tanks and the storage of liquefied cargo in the tanks, gas may be produced due to the evaporation of the cargo. This evaporated cargo gas is known as boil off gas (BOG). In order to prevent the build up of BOG in the tank, a system may be provided on the carrier to re-liquefy the BOG so that it can be returned to the storage tank in a condensed state. This can be achieved by the compression and cooling of the BOG. In many systems, the compressed BOG is cooled and condensed against seawater.

Liquefied cargoes comprising lower boiling point components, such as those with boiling points in the range of from greater than −110° C. to −55° C. when measured at 1 atmosphere, such as the petroleum gas ethane, which may be present as a component in natural gas liquids (NGLs), and the petrochemical gas ethylene, pose particular re-liquefaction problems. For instance, seawater may be unable to provide sufficient cooling duty to re-liquefy the ethane or ethylene component of BOG. In addition, the re-liquefaction of such BOG components may require greater compression (e.g. compared to the re-liquefaction of higher boiling point components such as propane).

Typically the re-liquefaction of ethylene requires a compression system capable of compressing the ethylene BOG to a pressure of approximately 51 bar, such as a compression system comprising three or more stages, and a cooling medium at a temperature of 9.5° C. or below in order to condense the compressed BOG stream.

Meanwhile, transportation of ethane has the issue of methane build up in the boil-off gas.

A need exists to provide an improved method of cooling, particularly re-liquefying, boil off gas from a liquefied cargo having a boiling point of greater than −110° C. when measured at 1 atmosphere in a floating transportation vessel. In particular, a method which provides improved cooling, particularly re-liquefaction, of lighter components of the cargo is desirable.

SUMMARY

The present invention addresses one of these problems by double or triple cooling to condense previously non-condensed components, which may be re-liquefied and subsequently returned to the liquefied cargo tank in the liquid phase. The double or triple cooled compressed BOG stream provides a source of increased cooling duty compared to heat exchange media such as seawater, allowing the re-liquefaction of lighter components in the BOG stream.

The present invention also considers the issue of vessel fuel.

Thus, for a given number of stages of compression, the method and apparatus disclosed herein allows liquefied cargoes having a boiling point of greater than −110° C. when measured at 1 atmosphere to be transported, without the need to add additional stages of compression or increase the venting of previously considered non-condensable components, whilst also potentially using one or more of the streams in the re-liquefaction process as vessel fuel streams. Viewed in another way, the method and apparatus described herein allow the extension of a compression system having a given number of stages of compression to cargoes having components which could not normally be re-liquefied or condensed.

In a first aspect, the present invention provides a method of cooling a boil off gas stream from a liquefied cargo in a floating transportation vessel, said liquefied cargo having a boiling points of greater than −110° C. when measured at 1 atmosphere, said method comprising at least the steps of:

- compressing a boil off gas stream from said liquefied cargo in two or more stages of compression comprising at least a first stage and a final stage to provide a compressed BOG discharge stream, wherein said first stage of compression has a first stage discharge pressure and said final stage of compression has a final stage suction pressure and one or more intermediate, optionally cooled, compressed BOG streams are provided between consecutive stages of compression;
- cooling the compressed BOG discharge stream against one or more first coolant streams to provide a first cooled compressed BOG stream;
- cooling the first cooled compressed BOG stream against at least one second coolant stream to provide a second cooled compressed BOG stream;
- providing a vessel fuel stream from the liquefied cargo;

using the vessel fuel stream as a coolant stream to cool either the compressed BOG discharge stream, or the first cooled compressed BOG stream, or both said streams.

Optionally, the method further comprises cooling the second cooled compressed BOG stream against a third coolant stream to provide a third cooled compressed BOG stream.

Optionally, the method further comprises the steps of:

expanding a portion of the third cooled compressed BOG stream to a pressure between that of the first stage discharge pressure and the final stage suction pressure to provide a first expanded cooled BOG stream;

using the first expanded cooled BOG stream as the third coolant stream to provide a first expanded heated BOG stream; and using the first expanded heated BOG stream as the or a second coolant stream.

In this way, the first expanded cooled BOG stream can be used as the third coolant stream in a heat exchange/exchanger against the second cooled compressed BOG stream, which heat exchange/exchanger provides a third cooled compressed BOG stream and a first expanded heated BOG stream as a heated third coolant stream, which can either indirectly, more preferably directly, be used as the primary or secondary second coolant stream.

That is, the first expanded heated BOG stream can be used as the primary or secondary second coolant stream in heat exchange/exchanger against the first cooled compressed BOG stream, which heat exchange/exchanger provides a second cooled compressed BOG stream and a first expanded further heated BOG stream as a heated second coolant stream.

The terms "first", "second", "third", "fourth", etc. as used herein are intended to indicate a connection or relationship, which may or may not be a direct sequence except where explicitly stated. That is, there may be one or more other steps or processes or locations between a "second" and "third" feature. The terms are used to clarify a different nature or presence of an associated feature in or of a stream, and the present invention is not limited by these terms.

For the avoidance of doubt, the second coolant stream (i.e. first expanded heated BOG stream) is at a lower temperature than the first cooled compressed BOG stream; the third coolant stream (i.e. first expanded cooled BOG stream) is at a lower temperature than the second cooled compressed BOG stream; and the third coolant stream is at a lower temperature than the second coolant stream.

According to another embodiment, the method further comprises:

combining the first expanded heated BOG stream, as a heated second coolant stream, with an intermediate compressed BOG stream, such as a first or a second intermediate compressed BOG stream, preferably with a first intermediate compressed BOG stream.

According to another embodiment of the present invention, the step of cooling the compressed BOG discharge stream against one or more first coolant streams to provide a first cooled compressed BOG stream may comprise:

cooling the compressed BOG discharge stream against a first refrigerant stream as a first coolant stream to provide a first cooled compressed BOG stream.

That is, a first refrigerant stream is used as one of the one or more first coolant streams in a heat exchange/exchanger against the compressed BOG discharge stream, which heat exchange/exchanger provides a first cooled compressed BOG stream and a heated first refrigerant stream as a heated first coolant stream.

According to another embodiment of the present invention, the step of cooling the compressed BOG discharge stream against one or more first coolant streams to provide a first cooled compressed BOG stream may comprise:

pre-cooling the compressed BOG discharge stream against a pre-cooling coolant stream as a first coolant stream to provide a pre-cooled compressed BOG stream;

cooling the pre-cooled compressed BOG stream against a first refrigerant stream as a first coolant stream to provide a first cooled compressed BOG stream.

That is, a pre-cooling coolant stream is used as one of the one or more first coolant streams in a heat exchange/exchanger against the compressed BOG discharge stream, which heat exchange/exchanger provides a pre-cooled compressed BOG stream and a heated pre-cooling coolant stream as a heated first coolant stream.

That is, a first refrigerant stream is used as one of the one or more first coolant streams in a heat exchange/exchanger against the pre-cooled compressed BOG stream, which heat exchange/exchanger provides a first cooled compressed BOG stream and a heated first refrigerant stream as a heated first coolant stream.

According to another embodiment of the present invention, the pre-cooling coolant stream may be part of an open pre-cooling coolant system or a closed pre-cooling coolant system. The pre-cooling coolant stream may be selected from a water stream, an air stream or a pre-cooling refrigerant stream, with a water or air stream being preferred. Typically if an open pre-cooling coolant circuit is used, the pre-cooling coolant stream may be selected from a seawater stream and an ambient air stream. Typically, if a closed pre-cooling coolant circuit is used, the pre-cooling coolant stream may be selected from a pre-cooling refrigerant stream.

According to another embodiment of the present invention, the cooling of the pre-cooled compressed discharge stream against the pre-cooling coolant stream is carried out in a pre-cooling heat exchanger such as a shell and tube heat exchanger or a plate heat exchanger.

According to another embodiment of the present invention, the one or more first coolant streams comprise a first refrigerant stream, such as a first refrigerant comprising a single refrigerant or mixture of refrigerants. The first refrigerant should be capable of condensing the cargo (i) at the discharge pressure of the compression system and the discharge temperature of the compression system or (ii) at the discharge pressure of the compression system and the temperature of the pre-cooled compressed BOG stream. The first refrigerant may comprise one or more organic compounds, ammonia, and particularly hydrocarbons and fluorinated hydrocarbons such as propane, propylene, difluoromethane and pentafluoromethane, including the fluorinated hydrocarbon mixture R-410A.

According to another embodiment of the present invention, the cooling of the compressed BOG discharge stream or the pre-cooled compressed discharge stream against the first refrigerant stream is carried out in a discharge heat exchanger such as a shell and tube heat exchanger, a plate heat exchanger or an economiser.

According to another embodiment of the present invention all the compressed BOG discharge stream is cooled against the one or more first coolant streams.

In one embodiment of the present invention, the liquefied cargo may be selected from the group comprising ethane, a liquefied petroleum gas, a liquefied petrochemical gas, and liquefied ammonia. The apparatus and method disclosed herein is of particular benefit for a liquefied cargo, such as ethane, and LPG, comprising light components, particularly ethane or ethylene in a concentration above 3.5 mol %. In yet another embodiment of the method, the liquefied cargo is LPG, particularly LPG comprising more than 3.5 mol % ethane, more particularly LPG comprising more than 5.0 mol % ethane.

The number of stages of compression is not a limiting factor of the present invention. Optionally, the method comprises two, three or four stages of compression Optionally, it is desired to provide a fully condensed boil off gas as the first cooled compressed BOG stream, but the present invention extends to a method wherein the boil off gas is not fully condensed after cooling against the one or more first coolant streams.

The present invention also overcomes the difficulty of using certain types of heat exchange, in particular certain types of heat exchanger, and more particularly conventional shell & coil economisers, where the temperature approach is limited by the composition of the fluid in the shell. Where the composition of the fluid in the shell may be a single component, i.e. a sufficiently 'pure' gas, its cooling against an expanded portion of the compressed BOG is well known and extensive. However, this cooling duty is reduced in a multi-component mixture, and is dramatically reduced in a multi-component mixture having a significant difference in boiling points, such as in particular ethane and methane. Thus, the present invention improves the coefficient of performance of the cooling cycle of a liquefied cargo comprising a significant amount of one or more lower boiling point gases, i.e. the present invention improves the coefficient of performance of cargo currently considered de minimus (e.g. 0.1 mol % or less such gas(es)), and allows operation with cargoes comprising much higher contents (e.g. about or above 0.4 or 0.5 mol % of such gas(es).

Optionally, the present invention comprises using the vessel fuel stream as a coolant stream to cool the first cooled compressed BOG stream, generally after its first cooling stage and before the second cooling stage. Such cooling could be provided by any type or form of heat exchanger known in the art, optionally as described herein, in order to use at least some of the cooling power of the liquefied cargo in exchange with the first cooled compressed BOG stream.

Optionally, the present invention comprises using the vessel fuel stream as a coolant stream to cool the first cooled compressed BOG stream and then to further cool the pre-cooled BOG stream, in a continuous path or passageway, prior to passage of the vessel fuel stream to one or more engines of the floating transportation vessel.

Optionally, the present invention comprises using the vessel fuel stream as a coolant stream to cool the compressed BOG generally after any pre-cooling stage. Such cooling could be provided by any type or form of heat exchanger known in the art, optionally as described herein, in order to use at least some of the cooling power of the liquefied cargo in exchange with the first cooled compressed BOG stream.

Engines for a floating transportation vessel are known in the art, and may comprise one or more engines, able to use one or more fuels. The present invention is not limited to a floating transportation vessel only using the cargo as an engine fuel. The present invention could supply a fuel stream to the engine or engines of the floating transportation vessel without limitation to the nature of the engine or engines.

Optionally, the vessel fuel stream is provided from the liquefied cargo by use of one or more suitable pumps, typically but not limited to an internal low pressure pump in a or in the cargo tank, and an external higher pressure or high pressure pump.

Optionally, the present invention extends to using at least an expanded portion of the third cooled compressed BOG stream, or at least an expanded portion of the cooled vent BOG return stream, or at least a portion of both said streams, as a vessel fuel stream.

That is, a portion of the third cooled compressed BOG stream could be expanded (using a conventional pressure reduction device known in the art, optionally as discussed herein), to create an expanded third cooled compressed BOG stream, which could then be used as a vessel fuel stream, optionally in combination with a vessel fuel stream that is provided from the liquefied cargo.

Additionally or alternatively, a portion of the cooled vent BOG return stream could be expanded (using a conventional pressure reduction device known in the art, optionally as discussed herein), to create an expanded cooled vent BOG return stream, which could then be used as a vessel fuel stream, optionally in combination with a vessel fuel stream that is provided from the liquefied cargo.

Optionally, the present invention extends to using at least an expanded portion of a gaseous vent stream, or at least an expanded portion of the vent discharge stream, or at least a portion of both said streams, as a vessel fuel stream.

That is, a portion of the vent gas stream could be expanded (using a conventional pressure reduction device known in the art, optionally as discussed herein), to create an expanded vent gas stream, which could then be used as a vessel fuel stream, optionally in combination with a vessel fuel stream that is provided from the liquefied cargo.

Additionally or alternatively, a portion of the vent discharge stream could be expanded (using a conventional pressure reduction device known in the art, optionally as discussed herein), to create an expanded vent discharge stream, which could then be used as a vessel fuel stream, optionally in combination with a vessel fuel stream that is provided from the liquefied cargo.

In this way, the present invention can provide some or all of the BOG stream or components thereof as some or all of the vessel fuel stream. For example, where the liquefied cargo is ethane, the BOG will comprise a higher methane content (due to its lower boiling point) than the liquefied ethane cargo, and the use of such BOG stream or a component thereof provides the additional benefit of using the higher methane containing stream as a vessel fuel stream, rather than returning some or all of said stream back into the liquefied ethane cargo. The purity of the liquefied ethane cargo can be maintained or even increased in this way, and the known problem in the art of the ever increasing proportion of BOG being comprised of methane can also be reduced or avoided.

In this way, the present invention can be used in the transportation of liquefied cargos having a boiling point of greater than −110° C. at 1 atmosphere. Optionally, the liquefied cargo comprises a plurality of components.

The present invention also seeks to maintain the use of current on-board equipment and apparatus with its known OPEX and CAPEX, rather than seeking to introduce and work out how to use new equipment with new operating requirements.

Thus, according to another embodiment of the present invention, the cooling of the first cooled compressed BOG stream against the second coolant stream is carried out in an economiser.

According to another embodiment of the present invention all the first cooled compressed BOG stream is cooled against the second coolant stream.

According to another embodiment of the present invention all the second cooled compressed BOG stream is cooled against the third coolant stream.

In another embodiment of the present invention, the method further comprises the steps of:

providing a gaseous vent stream from the first cooled compressed BOG stream;

expanding a portion of the third cooled compressed BOG stream to form a fourth coolant stream:

cooling the gaseous vent stream against the fourth coolant stream to provide a cooled vent stream and a heated fourth coolant stream.

In this way, the present invention can further provide increased re-liquefying of previously considered 'non-condensables' or 'non-condensing' components in the compressed BOG.

Preferably, the heated fourth coolant stream is or can be used as, a BOG recycle stream. Thus, the method may further comprise:

combining the heated fourth coolant stream with an intermediate compressed BOG stream, such as a first or second, preferably first intermediate compressed BOG stream.

Optionally, the method of the present invention comprising the further step of:

separating the cooled vent stream to provide a vent discharge stream and a cooled vent BOG return stream.

Optionally, the method of the present invention comprising the further steps of:

expanding the cooled vent BOG return stream to provide an expanded cooled vent BOG return stream;

passing the expanded cooled vent BOG return stream to a storage tank.

Optionally, the method comprises the further steps of:

expanding the cooled vent BOG return stream to provide an expanded cooled vent BOG return stream;

heat exchanging the expanded cooled vent BOG return stream against the vent discharge stream to provide a heat exchanged vent BOG return stream, a cooled vent discharge stream and a further vent discharge stream;

expanding the cooled vent discharge stream to provide an expanded cooled vent discharge stream;

passing the heat exchanged vent BOG return stream and the expanded cooled vent discharge stream to a storage tank.

Optionally, the stages of compression are the compression stages of a multi-stage compressor.

The first cooled compressed BOG stream is cooled against at least one second coolant stream to provide a second cooled compressed BOG stream. Optionally, the first cooled compressed BOG stream is wholly or substantially cooled against a second coolant stream only comprising the first expanded heated BOG stream. Preferably, all of the second coolant stream comprises the first expanded heated BOG stream. That is, first cooled compressed BOG stream may be cooled against one or more other second coolant streams, but these are secondary or minor compared to the cooling provided by the use of the first expanded heated BOG stream.

Optionally, the first expanded heated BOG stream used as the second coolant stream comprises both liquid and gas phases. That is, it does not need to be separated into separate gas and liquid phases prior to use as a second coolant stream.

Preferably, the liquid and gas phases of the first expanded heated BOG stream used as the second coolant stream are separated in the cooling of the first cooled compressed BOG stream. This is preferably by the apparatus allowing the first cooled compressed BOG stream to be cooled, preferably an economiser.

According to a second aspect of the present invention, there is provided an apparatus to cool a boil off gas stream from a liquefied cargo in a floating transportation vessel comprising a plurality of components, said liquefied cargo having a boiling point of greater than −110° C. at 1 atmosphere, said apparatus comprising at least:

a compression system to compress a boil off gas stream from a liquefied cargo, said compression system comprising two or more stages of compression comprising at least a first stage and a final stage to provide a compressed BOG discharge stream, wherein intermediate, optionally cooled, compressed BOG streams are provided between consecutive stages of compression;

one or more first heat exchangers to cool the compressed BOG discharge stream to provide a first cooled compressed BOG stream;

one or more second heat exchangers to further cool the first cooled compressed BOG stream against a mixed phase coolant stream to be separated in the one or more second heat exchangers, to provide a second cooled compressed BOG stream;

one or more vessel fuel heat exchangers to cool either the compressed BOG discharge stream, or the first cooled compressed BOG stream, or both said streams, using a vessel fuel stream as a coolant stream.

Optionally, the apparatus further comprises one or more third heat exchangers to further cool the second cooled compressed BOG stream to provide a third cooled compressed BOG stream.

Optionally, the apparatus as defined herein is operable using the method as defined herein.

Preferably, the second heat exchanger is an economiser.

According to a further aspect of the present invention, there is provided a floating transportation vessel for a liquefied cargo having a boiling point of greater than −110° C. at 1 atmosphere, and having the apparatus as defined herein or operating the method as defined herein.

The present invention is applicable to any floating transportation vessel for a liquefied cargo having a boiling point of greater than −110° C. at 1 atmosphere. The present invention may be utilized in floating transportation vessels where the liquefied cargo storage tanks are fully refrigerated to maintain the cargo in liquid phase at approximately atmospheric pressure by lowering the temperature, as well as in those vessels in which the cargo in the storage tanks is maintained in the liquid phase by a combination of reduced temperature and increased pressure versus ambient.

In order to obtain the benefits of the method and apparatus disclosed herein, the use of economizers is not required. However, in certain embodiments, heat exchangers such as economizers can be placed between consecutive stages of compression, such as between the first and second stages, to cool the intermediate compressed BOG streams. Where three or more stages of compression are present, heat exchangers, such as economizers or intercoolers, such as seawater intercoolers, to allow the cooling of an intermediate compressed BOG streams may be provided between the second and final stages of compression.

For instance, an intercooler can be situated between the second and third stages of compression. Alternatively, an economizer can be situated between the second and third, as well as between the first and second stages of compression. In an economizer, an expanded, optionally further cooled, portion of the cooled compressed BOG stream can be heat exchanged with an intermediate compressed BOG stream. In a further embodiment, an expanded, optionally further cooled, portion of the cooled compressed BOG stream can be heat exchanged with an optionally further cooled portion of the cooled compressed discharge stream. This leads to further improvements in the coefficient of performance and increased cooling, particularly re-liquefaction, capacity.

It will be apparent that the method and apparatus disclosed herein can be applied to an existing floating transportation vessel as a retro-fit, by maintaining the number of stages of compression present and adding the necessary piping, valves and controls to carry out the cooling of a second cooled compressed BOG stream against an expanded portion of the third cooled BOG stream.

As used herein, the term "multiple stages of compression" defines two or more stages of compression in series in a compression system. Each stage of compression may be achieved by one or more compressors. The one or more compressors of each compression stage may be independent from those of the other stages of compression, such that they are driven separately. Alternatively, two or more of the stages of compression may utilize compressors which are linked, typically powered by a single driver and drive shaft, with optional gearing. Such linked compression stages may be part of a multi-stage compressor.

The method and apparatus disclosed herein requires at least two stages of compression. After the first stage of compression, each subsequent stage provides an increased pressure compared to the pressure at the discharge of a previous stage. The term "consecutive stages" refers to pairs of adjacent stages of compression i.e. a stage (n) and the next (n+1) stage where 'n' is a whole number greater than 0. Consequently, consecutive stages are, for instance, first and second stages or second and third stages or third and fourth stages. Intermediate compressed streams (and cooled intermediate compressed streams) refer to those streams connecting consecutive stages of compression. The terms "next stage of compression" or "subsequent stage of compression" used in relation to the cooled intermediate compressed stream refer to the numerically higher number (and higher pressure stage) of the two consecutive stages defining the intermediate stream.

The heat exchange steps may be indirect, where the two or more streams involved in the heat exchange are separated and not in direct contact. Alternatively, the heat exchange may be direct, in which case the two or more streams involved in the heat exchange can be mixed, thereby producing a combined stream.

According to a further aspect of the present invention, there is provided a method integratively designing apparatus to cool a boil off gas stream from a liquefied cargo having a boiling point of greater than −110° C. at 1 atmosphere, in a floating transportation vessel comprising a plurality of components, comprising the steps of:

selecting a compression system to compress a boil off gas stream from a liquefied cargo, said compression system comprising two or more stages of compression comprising at least a first stage and a final stage to provide a compressed BOG discharge stream, wherein intermediate, optionally cooled, compressed BOG streams are provided between consecutive stages of compression, selecting one or more first heat exchangers to cool the compressed BOG discharge stream to provide a first cooled compressed BOG stream;

selecting one or more second heat exchangers to further cool the first cooled compressed BOG stream against a mixed phase coolant stream to be separated in the one or more second heat exchangers, to provide a second cooled compressed BOG stream; and selecting one or more vessel fuel heat exchangers to cool either the compressed BOG discharge stream, or the first cooled compressed BOG stream, or both said streams, using a vessel fuel stream as a coolant stream.

Optionally, the method further comprises selecting one or more third heat exchangers to further cool the second cooled compressed BOG stream to provide a third cooled compressed BOG stream.

Optionally, the method further comprises the steps of:

running a process simulation for said apparatus;

determining the effectiveness of the method;

altering a process variable in said process simulation; and repeating the process simulation.

According to a further aspect of the present invention, there is provided a method of designing process for the cooling a boil off gas stream from a liquefied cargo having a boiling point of greater than −110° C. at 1 atmosphere, in a floating transportation vessel, said method comprising at least the steps of:

designing a compression system to compress a boil off gas stream from a liquefied cargo, said compression system comprising two or more stages of compression comprising at least a first stage and a final stage to provide a compressed BOG discharge stream, wherein intermediate, optionally cooled, compressed BOG streams (are provided between consecutive stages of compression, designing one or more first heat exchangers (to cool the compressed BOG discharge stream to provide a first cooled compressed BOG stream;

designing one or more second heat exchangers to further cool the first cooled compressed BOG stream against a mixed phase coolant stream to be separated in the one or more second heat exchangers to provide a second cooled compressed BOG stream; and designing one or more vessel fuel heat exchangers to cool either the compressed BOG discharge stream, or the first cooled compressed BOG stream, or both said streams, using a vessel fuel stream as a coolant stream.

Optionally, the method further comprises designing one or more third heat exchangers to further cool the second cooled compressed BOG stream to provide a third cooled compressed BOG stream.

Optionally the method further comprising the steps of:

running a process simulation for said process;

determining the effectiveness of the method;

altering a process variable in said process simulation; and repeating the process simulation.

The designing methods as discussed herein may incorporate computer aided processes for incorporating the relevant operational equipment and controls into the overall vessel construction and may incorporate relevant cost, capacity of operation parameters into the methodology and design. The methods described herein may be encoded onto media that is suitable for being read and processed on a computer. For example, code to carry out the methods described herein may be encoded onto a magnetic or optical media which can be read by and copied to a personal or mainframe computer.

The methods may then be carried out by a design engineer using such a personal or mainframe computer.

Certain features of the present invention and its method of design may be described in terms of a set of numerical upper limits and a set of numerical lower limits. It should be appreciated that any ranges formed by any combination of such limits are contemplated to fall within the scope of the invention. Further the overall design is contemplated to include the selection of additional structures for use with the combination herein specifically defined. The various structures operational parameters may be selected for a limited or fixed basis or selected for flexible or multiple operational use within the vessel. Hence, it is intended that the method of design covers alternatives, modifications, and equivalents with respect to the overall design of the vessel and any off-vessel that are included within the spirit and scope of the invention.

BRIEF DESCRIPTION OF THE DRAWINGS

Embodiments of the invention will now be described by way of example only, and with reference to the accompanying non-limiting drawings in which.

DETAILED DESCRIPTION

Floating re-liquefaction systems draw the vapor, also known as boil off gas, from one or more storage tanks and pass the boil off gas to a compressor in which it is compressed such that the compressed vapor can be cooled and condensed against one or more coolants as the heat sink/refrigerant. For instance, seawater may be used to pre-cool, typically de-superheat, the compressed vapour in an open cycle pre-cooling circuit. The pre-cooled compressed vapour can then be further cooled against a refrigerant in a closed cycle refrigerant circuit.

Those lighter components of the compressed vapor which cannot be condensed against the refrigerant are usually vented to the atmosphere or recycled to the storage tanks in vapor form. Typically, the liquefied cargo is kept in the storage tank under one or both of reduced temperature (versus ambient) and increased pressure (versus atmospheric).

The methods and apparatus disclosed herein seek to provide improved methods and apparatus of re-liquefying BOG, and/or using the cargo as a vessel fuel, and/or using BOG as a vessel fuel.

Figure 1:
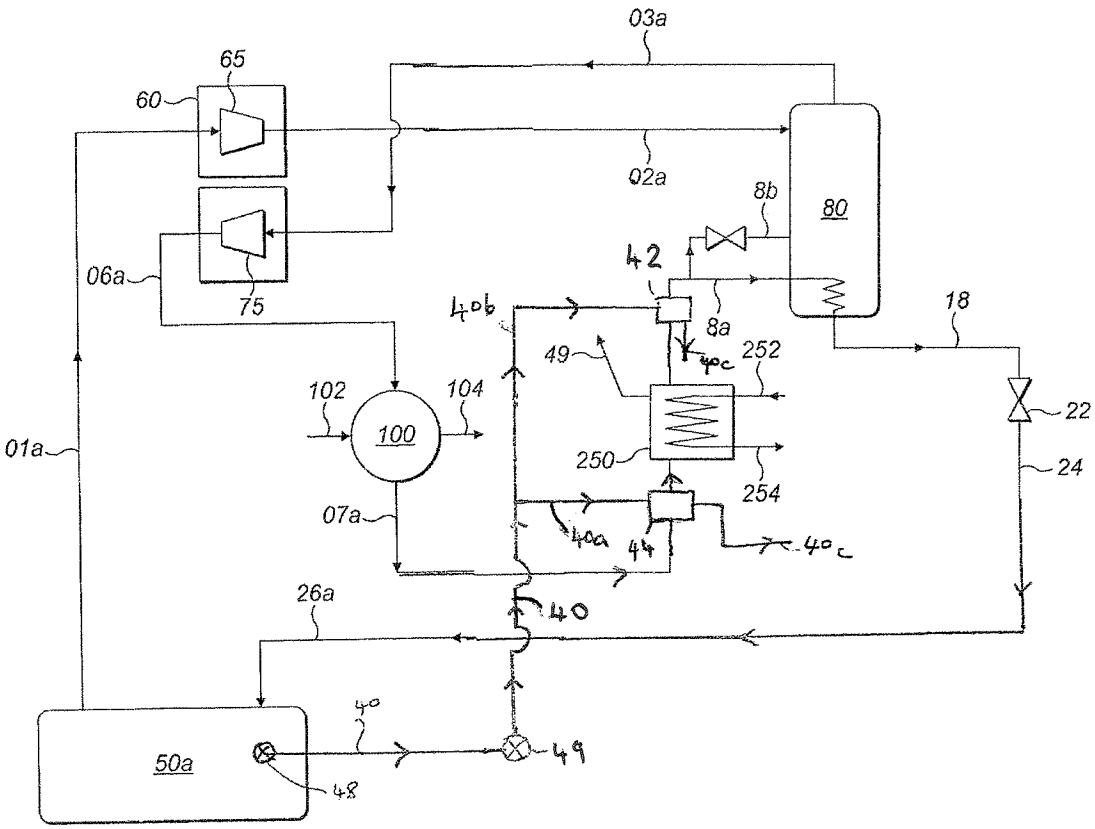
FIG. 1 shows a schematic diagram of a system of cooling, particularly re-liquefying, boil off gas from a liquefied cargo having a boiling point of greater than −110° C. at 1 atmosphere, in a floating transportation vessel according to one embodiment of the invention.

An embodiment of the method and apparatus according to the present invention is disclosed in FIG. 1. FIG. 1 shows a schematic diagram of a system of cooling, particularly re-liquefying, boil off gas from a liquefied cargo in a floating transportation vessel according to one embodiment of the invention. The cargo can be any one of the gases discussed herein: ethane is selected as a representative.

Liquefied ethane cargo is stored in a tank 50*a* which may be insulated and/or pressurized in order to maintain the ethane in a liquefied state. Vaporization of the ethane in the tank, for instance due to imperfect thermal insulation, will result in the formation of ethane gas in the overhead space of the tank 50*a*, and such gas is commonly termed boil off gas (BOG). In order to prevent the build-up of this gas, it is removed from the tank 50*a* as a boil off gas stream 01*a*. All the components are compressed, and as many of the components as possible of the removed boil off gas are normally cooled to condense them before it is returned to the tank 50*a*.

The boil off gas stream Ola can be passed to a compression system 60, such as the two stage compressor shown in FIG. 1 which comprises a first compression stage 65 and a second compression stage 75. The two-stage compression system 60 produces a compressed BOG discharge stream 06*a* which can be passed to a pre-cooling heat exchanger 100, in which the compressed BOG discharge stream 06*a* is cooled against a seawater stream 102. The pre-cooling heat exchanger 100 produces a pre-cooled compressed BOG stream 07*a* and a warmed seawater stream 104. The pre-cooling heat exchanger 100 can de-superheat the compressed BOG discharge stream 06*a*.

The pre-cooled compressed BOG stream 07*a* can be passed to a refrigerant heat exchanger 250, in which the pre-cooled compressed BOG stream 07*a* is cooled against a refrigerant stream 252. The refrigerant should be capable of condensing liquefied cargo at the discharge pressure of the compression system 60. The refrigerant may be propane or propylene. The refrigerant stream 252 can be part of a refrigerant circuit (not shown) comprising the refrigerant heat exchanger 250, a refrigerant compressor and a refrigerant cooler. The refrigerant circuit may be a closed refrigerant system. Such refrigerant circuits, also called refrigerant packs, are well known.

The refrigerant heat exchanger 250 produces a cooled compressed BOG stream 8*a* and a heated refrigerant stream 254. The cooled compressed BOG stream 8*a* is an at least partially condensed stream comprising those components of the boil off gas capable, at the discharge pressure of the second stage of compression 75, of 're-liquefaction', i.e. condensation, against the refrigerant.

The 'non-condensed' components which are incapable of re-liquefaction against the refrigerant in this system, and which may comprise both non-condensable' components and 'in-condensable' components as discussed herein, may be removed from the refrigerant heat exchanger 250, or an associated accumulator (not shown) located downstream of the refrigerant heat exchanger 250 as a vent stream 49, which is a vapor stream.

The cooled compressed BOG stream 8*a* can be passed to a further heat exchanger 80, to provide a cooled return fluid stream 18, which is typically a fully condensed stream.

The cooled return fluid stream 18 may then be passed to a return pressure reduction device 22, such as an expander or Joule-Thomson valve, to provide an expanded cooled return fluid stream 24. Typically, the return pressure reduction device 22 will reduce the pressure of the cooled return fluid stream 18 from at or near the pressure of the compressed BOG discharge stream 06*a* to a pressure close to that of the liquid cargo and BOG in the tank 50*a*, such as a pressure just above that of the BOG in the tank which is sufficient to ensure an adequate flow of the expanded cooled return fluid stream 24 to the tank 50*a*. The pressure of the expanded cooled return fluid stream 24 is below that of the discharge pressure of the first stage 65 of compression.

Returning to compression system 60, the first stage 65 of compression provides a first intermediate compressed BOG stream 02*a*, which is passed to further heat exchanger 80. The first intermediate compressed BOG stream 02*a* can be heat exchanged against an expanded portion 8*b* of the cooled compressed BOG stream 8*a* in the further heat exchanger 80 to provide a cooled first intermediate compressed BOG stream 03*a*, which can then be passed to the suction of the second stage 75 of compression. The second stage 75 compresses the cooled first intermediate compressed BOG stream 03*a* to provide the compressed BOG discharge stream 06*a*.

FIG. 1 also shows a vessel fuel stream 40 provided from the tank 50*a*, optionally using an internal low pressure pump 48 and an external high pressure pump 49.

The vessel fuel stream 40 can be provided to a first vessel fuel heat exchanger 42 via line 40*a*. The first vessel fuel heat exchanger 42 located in the path of the cooled compressed BOG stream 8*a* prior to the further heat exchanger 80. Optionally, the first vessel fuel heat exchanger 42 could be located after the further heat exchanger 80 to cool the stream 18 rather than the stream 8*a*.

The first warmer vessel fuel stream 40*b* could be provided to the second vessel fuel heat exchanger 44 to cool the compressed BOG discharge stream 07*a* such that the vessel fuel stream 40 passes serially through the first and second vessel fuel heat exchangers 42, 44.

The first and second vessel fuel heat exchangers 42, 44 provide a warmer vessel fuel gas stream 40*c*.

Optionally, the second vessel fuel heat exchanger 44 could be located before the pre-cooling heat exchanger 100 to cool the compressed BOG discharge stream 06*a* rather than the pre-cooled compressed BOG stream 07*a*.

Alternatively, the vessel fuel stream 40 could be provided to the line 40*b* (not shown) such that the vessel fuel stream 40 passes in parallel through the first and second vessel fuel heat exchangers 42, 44.

The warmer vessel fuel gas streams 40*c* can be combined where separate, and then passed towards one or more engines (not shown), generally one or more engines in one or more engine compartments, optionally in combination with one or more other-fuel engines that are powering the floating transportation vessel of the cargo tank 50*a* and on which the arrangement shown in FIG. 1 resides.

The cooling arrangement shown in FIG. 1 using a vessel fuel stream 40 to provide additional cooling to reduce the compressor power requirement of the compression system, as the vessel fuel stream 40 is cooler than the refrigerant stream 252 and/or the sea water stream 102. Reduction in the compressor power requirement increases the overall efficiency of the BOG recovery operation. The requirement for and external heat source for the vessel fuel stream is reduced or eliminated. For the system under consideration a power reduction of about 20% is achievable. Additionally or alternatively, for the system under consideration an increase in cooling of 5-10% is achievable.

Figure 2:
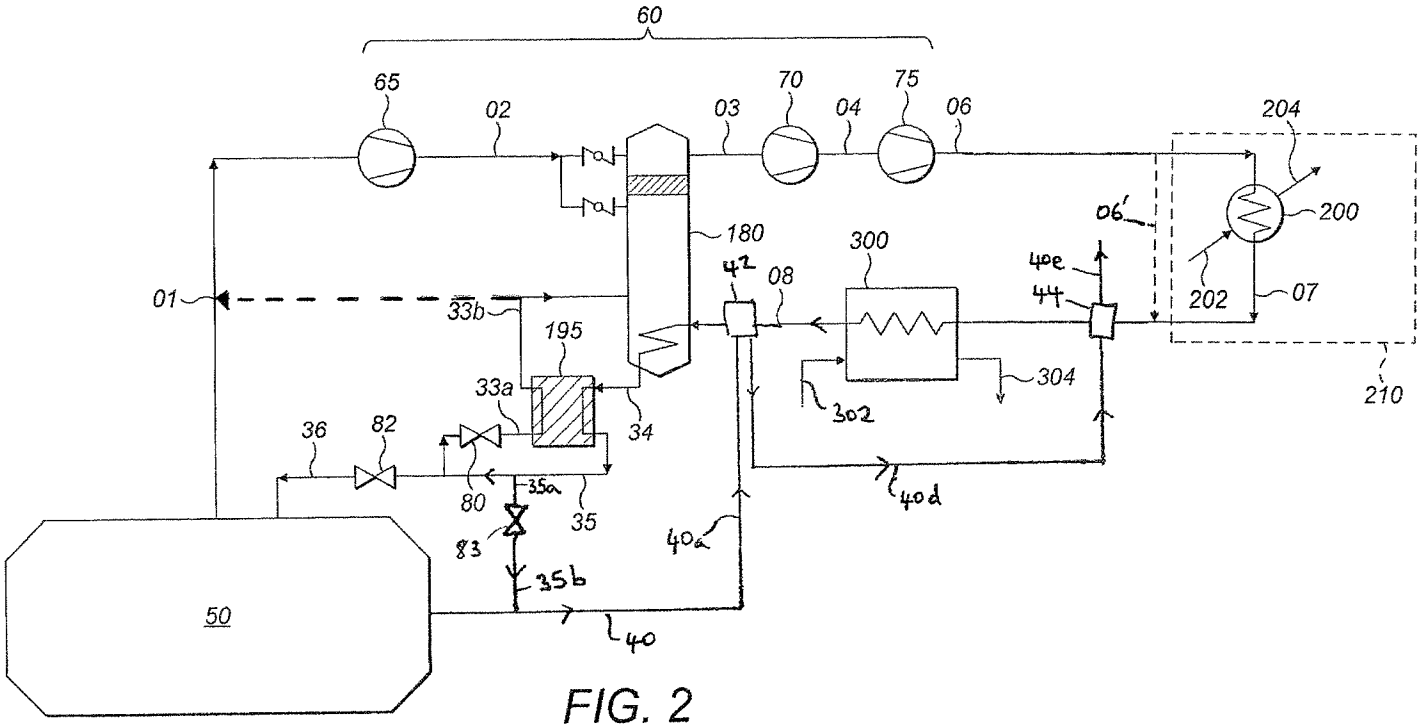
FIG. 2 shows a schematic diagram of a system of cooling, particularly re-liquefying, boil off gas from a liquefied cargo, in a floating transportation vessel according to another embodiment of the invention.

A second embodiment of the method and apparatus according to the present invention is disclosed in FIG. 2. Where appropriate, identical stream and component names, and the same reference numerals as those in FIG. 1 have been used for corresponding streams and components in the remaining Figures.

FIG. 2 shows a liquefied cargo storage tank 50 in a floating transportation vessel, such as an LPG carrier. In order to cool, particularly re-liquefy, evaporated cargo from the storage tank 50, a boil off gas stream 01, comprising evaporated cargo, is passed to a compression system 60 having two or more stages of compression. The boil off gas stream 01 may have a pressure (the "BOG pressure") in the range of from above 0 to 500 kPa gauge. The compression system 60 may be a multi-stage compressor comprising two or more stages. By "multi-stage compressor" it is meant that each compression stage in the compressor is driven by the same drive shaft. Alternatively, the compression system 60 may comprise independently driven compressors for each of the stages of compression. When the compression system 60 is a multi-stage compressor, it is typically a reciprocating compressor.

The embodiment of FIG. 2 shows a compression system 60 having a first stage 65 and a second stage 70 and a third and final stage 75, although the method and apparatus described herein is also applicable to compressors having two stages or more than three stages. The first stage 65 and final stage 75 of compression provide low and high pressure streams respectively at their discharge.

The compression system 60 compresses the boil off gas stream 01 to provide a compressed BOG discharge stream 06. The compressed BOG discharge stream 06 may have a pressure (the "final stage pressure") in the range of from 1.5 to 3.2 MPa or above, eg. up to 6 MPa.

The compressed BOG discharge stream 06 is cooled in one or more first heat exchangers 200, 300 against one or more first coolant streams 202, 302 to provide first cooled compressed BOG stream 08. In the embodiment of FIG. 2, the compressed BOG discharge stream 06 can be passed to a pre-cooling heat exchanger 200 as one of the one or more first heat exchangers. The compressed BOG discharge stream 06 is pre-cooled against a pre-cooling coolant stream as one of the one of more first coolant streams. The pre-cooling coolant stream 202 may be an air or a water stream, such as an ambient air or seawater stream. The pre-cooling heat exchanger 200 may be a shell and tube heat exchanger or a plate heat exchanger. The pre-cooling heat exchanger may de-superheat the compressed BOG discharge stream 06. The pre-cooling heat exchanger 200 provides a pre-cooled compressed BOG stream 07 and heated pre-cooling coolant stream 204. Typically, the seawater used as the pre-cooling coolant would have a temperature of +36° C. or below, more typically +32° C. or below.

The pre-cooling heat exchange/exchanger 200 is optional in the method and apparatus disclosed herein. It is advantageous because it reduces the cooling duty of the subsequent cooling steps. However, is it not an essential aspect, such that in an alternative embodiment, the compressed BOG discharge stream 06 can be passed directly to the discharge heat exchanger 300 via line 06', such that the equipment shown by numeral 210 may be omitted. In such circumstances, the cooling capacity of the discharge heat exchanger 300 would have to be increased to compensate for the absence of pre-cooling.

The pre-cooled compressed BOG stream 07 can then be passed to a discharge heat exchanger 300 as another of the one or more first heat exchangers. The discharge heat exchanger 300 cools the pre-cooled compressed BOG stream 07 against a first refrigerant stream 302 as another of the one or more first coolant streams. The discharge heat exchanger 300 provides a first cooled compressed BOG stream 08 and a heated first refrigerant stream 304.

The first refrigerant stream 302, discharge heat exchanger 300 and heated first refrigerant stream 304 may be part of a first refrigerant system (not shown). Such a first refrigerant system may further comprise a first refrigerant compressor to compress the heated first refrigerant stream 304 to provide a compressed first refrigerant stream, a first refrigerant cooler to cool the first refrigerant to provide a cooled compressed first refrigerant stream and a first refrigerant expansion device to expand the cooled compressed first refrigerant stream to provide the first refrigerant stream 302. The first refrigerant system may be a closed system. The first refrigerant may comprise one or more organic compounds, particularly hydrocarbons and fluorinated hydrocarbons such as propane, propylene, difluoromethane and pentafluoromethane, including the fluorinated hydrocarbon mixture R-410A, as well as one or more inorganic compounds such as ammonia.

The first cooled compressed BOG stream 08 may be a partially condensed, compressed BOG stream, comprising those components of the boil off gas which can be condensed against the first refrigerant at the discharge pressure of the final stage of compression. Any non-condensed components can be removed either from the discharge heat exchanger 300 as a vent stream (not shown) or from a discharge receiver (not shown) which functions as a gas/liquid separator located downstream of the discharge heat exchanger 300. Discharge heat exchangers suitable for the separation of gaseous and liquid components are shell and tube heat exchangers in which the cooled compressed BOG is located in the shell-side.

Any discharge receiver may be an accumulator and can operate to maintain a liquid seal in the discharge heat exchanger 300 and/or maintain the discharge pressure at the final stage 75 of compression.

The discharge heat exchanger 300 may be of a type which could not adequately separate vapor and condensed phases into separate streams, such as a plate and fin type heat exchanger. In such a situation, the discharge receiver will be located downstream of the discharge heat exchanger 300 to separate the non-condensed components as a vent stream.

The first cooled compressed BOG stream 08 is then second cooled. This can be achieved by passing the first cooled compressed BOG stream 08 to a second heat exchanger 180. The second heat exchanger 180 may be of any type, and an intermediate stage, particularly first stage, economizer for cooling the intermediate BOG streams 02 or 04 as well as the first cooled compressed stream 08 is shown in FIG. 2.

The cooling of the first cooled compressed BOG stream 08 is against a second coolant stream to provide a second cooled compressed BOG stream 34. Optionally, a portion of the first cooled compressed BOG stream 08 can be used elsewhere prior to passage into the second heat exchanger 180, but in the present embodiment, it is preferred that wholly or substantially all of the first cooled compressed BOG stream 08 passes into the first heat exchanger 180.

The action of the second coolant, described hereinafter, is to provide a second cooled compressed BOG stream 34. Again, a portion of this stream 34 could be used elsewhere, but preferably wholly or substantially all of the second cool compressed BOG stream 34 passes into a third heat exchanger 195 to further cool the second cooled compressed BOG stream 34 and to provide a third cooled compressed BOG stream 35.

The third heat exchanger 195 may be of any type, such as an economiser, but is preferably a countercurrent heat exchanger such as a plate and fin heat exchanger known in the art.

In the present embodiment of the invention, a portion of the third cooled compressed BOG stream 35 is expanded to a pressure between that of the first stage discharge pressure and the final stage suction pressure to provide a first expanded cooled BOG stream 33*a*. This action can be carried out through a pressure reduction device 81 such as a Joule-Thomson valve or expander in a manner known in the art.

The first expanded cooled BOG stream 33*a* is used as the third coolant in the third heat exchanger 195, which heat exchange provides the third cooled compressed BOG stream 35, and a first expanded heated BOG stream 33*b* as heated third coolant stream 33*b*, which can either indirectly, or more preferably directly, be used as the second coolant stream 33*b*. The first expanded heated BOG stream/second coolant stream 33*b* is not separated (to separate gas/liquid phases) prior to use as the second coolant stream 33*b*, to fully utilise all of the remaining cooling effect of the first expanded heated BOG stream after use in the third heat exchanger 195.

The first expanded heated BOG stream/second coolant stream 33*b* is passed into the second heat exchanger 180, such that the heat exchange with the first cooled compressed BOG stream 08 provides the second cooled compressed BOG stream 34 and a heated second coolant in the second heat exchanger 180. The heated second coolant may comprise vapour and liquid components, which are conveniently separated in the second heat exchanger 180, and which is discussed hereinafter. The heated second coolant stream, which is a first expanded further heated BOG stream, may be passed to an intermediate compressed BOG stream of the appropriate pressure. In the embodiment of FIG. 2, the heated second coolant stream is combined with the first intermediate compressed BOG stream 02.

The portion of the third cooled compressed BOG stream 35 which is not used to provide the first expanded cooled BOG stream 33*a* can be returned as a return stream to the cargo tank 50 via a pressure reduction device 82 as expanded cooled BOG return stream 36 in a manner known in the art.

FIG. 2 also shows the provision of a vessel fuel stream 40 from the cargo tank 50, to provide a line 40*a* into a first vessel fuel heat exchanger 42 in the path of the first cooled compressed BOG stream 08 to cool said stream 08 after the discharge heat exchanger 300. The warmer vessel fuel gas stream 40*d* from the first vessel fuel heat exchanger 42 is provided into a second vessel fuel heat exchanger 44 in the path of the pre-cooled compressed BOG stream 07 to provide cooling to said stream 07 after the pre-cooling heat exchanger 200, (and optionally either before or after any direct stream 06' not passing through the equipment 210). The warmer vessel fuel stream 40*e* can then be provided to one or more engines of the floating transportation vessel on which the arrangement shown in FIG. 2 resides in a manner described herein before. Optionally, vessel fuel heat exchanger 42 may alternatively be provided to cool stream 34.

FIG. 2 also shows optionally using a portion of the third cooled compressed BOG stream 35 to pass along line 35*a*, through a pressure reduction device 83, to provide an expanded third cooled compressed BOG stream 35*b*, which can alternatively or additionally be used as vessel fuel. That is, the volume of vessel fuel in line 40*a* could be partly or wholly provided by the expanded third cooled compressed BOG stream 35*b*, either for a limited duration or periods, or wholly or substantially over time.

Optionally, stream 33*b* is passed to the BOG stream 01. This will reduce the temperature of stream 35 to be more compatible with the requirements of the vessel fuel stream 40.

Thus, the present embodiment provides that the vessel fuel supplied to the first and/or second vessel fuel heat exchangers 42, 44 is provided either from the third cooled compressed BOG stream 35, or from the cargo tank 50, or from a combination of same, which combination can vary either over time, or over volume, or over both, depending on the fuel demand and/or efficiency desired in and from the overall method and apparatus shown in FIG. 2.

The skilled man can calculate possible division of the third cooled compressed BOG stream 35 between the line 35*a* and passage into the pressure reduction devices 81 and 82, which achieves the best overall power/efficiency balance for the floatation transportation vessel requirements. For the system under consideration a power reduction of about 20% is achievable. Additionally or alternatively, for the system under consideration an increase in cooling of about 50% is achievable.

It is also a particular feature of the present embodiment that no CAPEX change is required in the nature of the first heat exchangers 200, 300 and second heat exchanger 180, such that the operator can continue to use a 'conventional' shell and tube economiser as the second heat exchanger 180, and that the present embodiment can be achieved simply with the addition of the one or two vessel fuel heat exchangers 42, 44 and the optional third heat exchanger 195. This allows the overall BOG re-liquefying system to be controlled by existing level controllers in at least the second heat exchanger 180, avoiding potential issues with temperature control that might arise with the use of different BOG compositions and different inter stage pressures.

Indeed, an improvement of 10-15% in the refrigeration capacity of a BOG re-liquefying method and apparatus for a liquefied cargo is possible for ethane cargoes containing methane (in the liquid phase) above a de minimus level, and even above 0.4 or 0.5 mol % methane. Such methane-containing liquefied ethane cargos may be increasingly common where new or other sources of ethane are being provided, but the desire to purify the ethane (by reducing or eliminating any methane content) prior to transportation is not cost effective, or in some cases, not locally possible.

Figure 3:
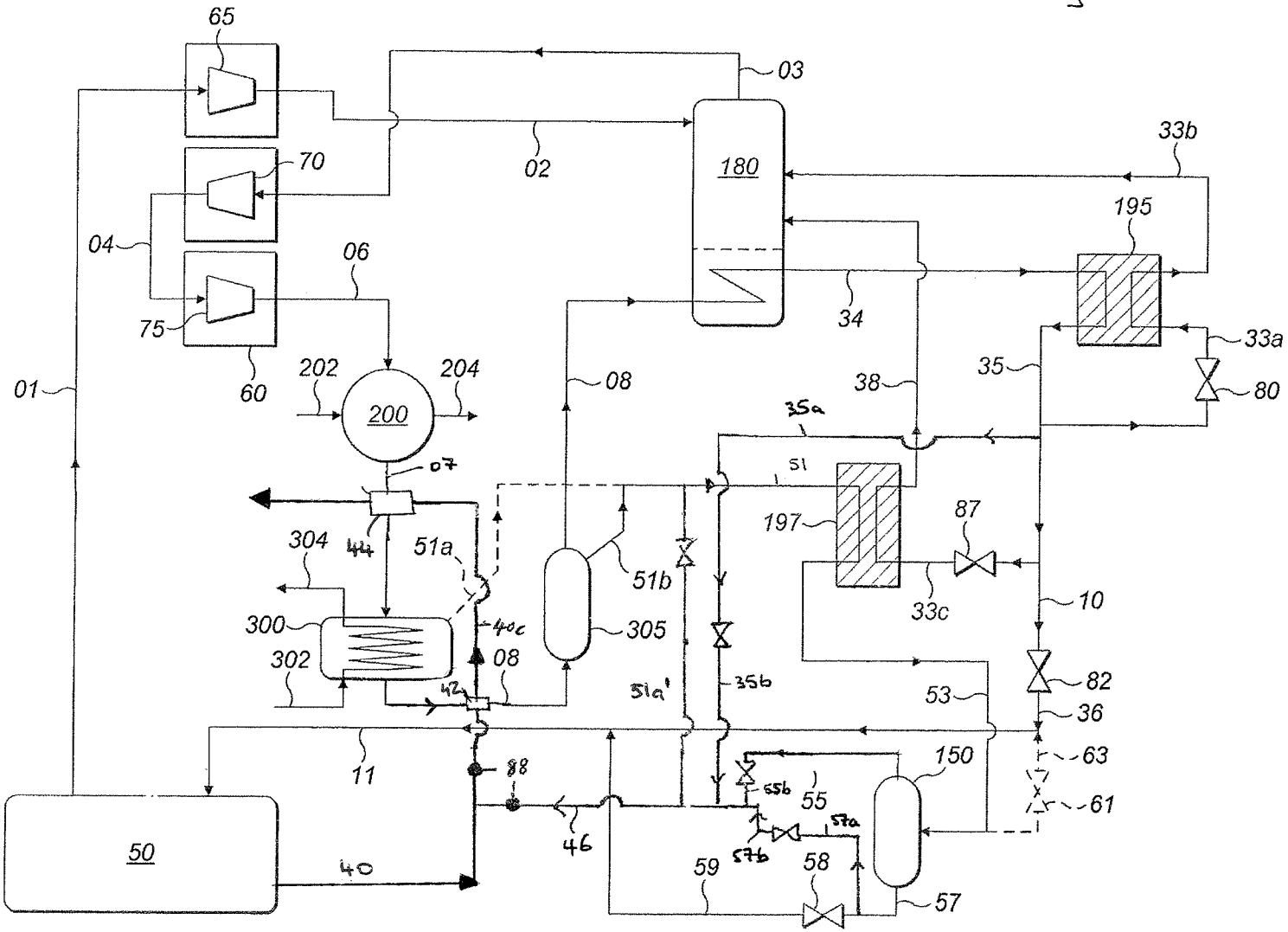
FIG. 3 shows a schematic diagram of a system for cooling, particularly re-liquefying, boil off gas from a liquefied, in a floating transportation vessel according to another embodiment of the invention.

FIG. 3 shows a further embodiment of the method and apparatus of the present invention. In common with FIG. 2, FIG. 3 shows a liquefied cargo storage tank 50 from which a boil off gas stream 01, comprising evaporated cargo, is passed to a compression system 60, having three stages of compression being a first stage 65, a second and intermediate stage 70 and a third and final stage 75. The first stage 65 provides a first intermediate compressed BOG stream 02 which passes into the second heat exchanger 180 to provide a cooled first intermediate BOG stream 03 which passes into the intermediate compression stage 70, to provide a second intermediate compressed BOG stream 04 which passes into the suction of the final stage 75 of compression.

The compression system 60 provides a compressed BOG discharge stream 06 which can be passed into a pre-cooling heat exchanger 200 as one of the one or more first heat exchangers to be cooled against one first coolant being seawater in a seawater stream 202 in a manner previously described, to provide a pre-cooled compressed BOG stream 07.

The pre-cooled compressed BOG stream 07 can then be passed to a discharge heat exchanger 300 as another of the one or more first heat exchangers in a manner previously described. The discharge heat exchanger 300 provides a first cooled compressed BOG stream 08 and a heated first refrigerant stream 304.

The first cooled compressed BOG stream 08 can be provided either directly, or optionally after passage through a discharge receiver 305 as shown in FIG. 3.

Where the cooled compressed BOG stream 08 is not fully condensed, there is a gaseous vent stream 51 also provided, either from the discharge heat exchanger 300 as stream 51*a*, and/or from the discharge receiver 305 as stream 51*b*. Whilst FIG. 3 shows the two streams 51*a*, 51*b* as separate, such streams may be provided separately or combined or without any distinction, depending upon the nature and construction of the discharge heat exchanger 300 and the discharge receiver 305. The provision of these stream or streams is known in the art.

The gaseous vent stream 51 may comprise both 'non-condensable' components and 'in-condensable' components. The in-condensable components are generally considered to be components which cannot practically ever by compressed and condensed within the confines and operating parameters of a particular floating transportation vessel BOG cooling system, and primarily relate to nitrogen.

In WO2012/143699A, there is shown a method and apparatus for increasing the amount or proportion of condensing of the gaseous vent stream in order to increase the recovery thereof.

In the present embodiment, the method and apparatus may further comprise, as shown by way of example in FIG. 3, the steps of expanding a portion of the third cooled compressed BOG stream 35 to form a fourth coolant stream 33*c*, generally by passage of a portion of the third cooled compressed BOG stream 35 through a pressure reduction valve 87 in an amount which allows that portion of the third cooled compressed BOG stream 35 to act as a fourth coolant 33*c* in a fourth heat exchanger 197, such as a vent heat exchanger.

The fourth heat exchanger 197 may be of any type, but is preferably a counter-current heat exchanger such as a plate and fin arrangement. As shown in FIG. 3, the gaseous vent stream 51 can be cooled against the fourth coolant stream 33*c* to provide a cooled vent stream 53 and a heated fourth coolant stream 38.

Optionally, the heated fourth coolant stream 38 is a BOG recycle stream which can pass into the second heat exchanger 180 such that vapour therefrom can be used as part of the cooled first intermediate BOG stream 03.

The cooling of the gaseous vent stream 51 in the vent heat exchanger 197 can condense a portion of the components of the boil off gas which could not be condensed in the discharge heat exchanger 300 against the first refrigerant such as propane or propylene. The cooled vent stream 53 is typically an at least partly condensed stream.

In one possible embodiment shown in FIG. 3, the cooled vent stream 53 can be passed to a vent stream pressure reduction device 61 (dashed line), such as a Joule-Thomson valve or expander, where its pressure is reduced to provide an expanded further cooled vent stream 63 (dashed line). The expanded further cooled vent stream 63 may have a pressure at or slightly above the pressure of the liquefied cargo storage tank 50, so that it can be returned to the tank, for instance by addition to expanded cooled BOG return stream 36 to provide combined expanded cooled BOG return stream 11.

In another possible embodiment shown in FIG. 3, the cooled vent stream 53 can be passed to a vent stream separator 150, such as a gas/liquid separator. The vent stream separator 150 provides a vent discharge stream 55 being wholly or substantially the in-condensable components, which is typically a vapour stream, and a cooled vent BOG return stream 57, which is typically a condensed stream, comprising those components of the boil off gas which were condensed in the fourth heat exchanger 197. The pressure of the vent discharge stream 55 may be reduced, for instance to a pressure appropriate for return to the storage tank 50, for storage elsewhere or for venting.

The cooled vent BOG return stream 57 may be passed through a vent return stream pressure reduction device 58, such as a Joule-Thomson valve or expander, to provide an expanded cooled vent BOG return stream 59. The expanded cooled vent BOG return stream 59 can be passed to the storage tank 50, for instance by addition to the expanded cooled BOG return stream 36.

That portion of the third cooled compressed BOG stream 35 that is not passed to the pressure reduction devices 81 and 87 to provide the third and fourth coolant streams 33*a*, 33*c*, provides a BOG return stream 10, which may be expanded by a pressure reduction valve 82 to at or near the pressure of the storage tank 50 as expanded cooled BOG return stream 36. This can then be returned to the storage tank 50.

FIG. 3 shows a similar vessel fuel arrangement to FIG. 2, wherein a vessel fuel stream 40 is provided from the cargo tank 50 into a first vessel fuel heat exchanger 42 located in the path of the first-cooled compressed BOG stream 08 (and/or the stream 34 (not shown)), to provide a warmer vessel fuel stream 40*c*, which passes into a second vessel fuel heat exchanger 44 in the path of the pre-cooled compressed BOG stream 07 after the discharge heat exchanger 200. The second vessel fuel heat exchanger 44 provides cooling to the pre-cooled compressed BOG stream 07, to provide a warmer vessel fuel stream 40*h* in a manner described herein above.

FIG. 3 also shows one or more alternative or additional options for providing vessel fuel from the cooling arrangement in FIG. 3, which could be used as an alternative or in addition to the vessel fuel stream 40 to provide the vessel fuel stream 40*h* that is directed towards the engine or engines of the floating transportation vessel on which the arrangement shown in FIG. 3 resides.

FIG. 3 shows a first option comprising using a portion of the third cooled compressed BOG stream 35 taken along line 35*a*, to pass through a pressure reduction device to provide an expanded third cooled BOG stream 35*b*.

A second option comprises using a portion of the cooled vent BOG return stream 57 taken along line 57*a*, and through a pressure reduction device to provide an expanded cooled vent BOG return stream 57*b*.

A third option comprises using a portion of the vent stream 51*b* from the discharge receiver 305 taken along line 51*c*, through a pressure reduction device to provide an expanded vent stream 51*c*.

A fourth option comprises using a portion of, optionally all of, the vent discharge stream 55 from the vent stream separator 150 through a pressure reduction device to provide an expanded vent discharge stream 55*b*.

The arrangements shown in FIG. 3 allows each of the expanded streams 51*c*, 35*b*, 55*b* and 57*b* to be provided either through a combined line 46, or through separate lines (not shown), to provide at least some of the final vessel fuel stream 40*h*, optionally as an alternative to the vessel fuel stream 40, or in combination therewith, or in one or more varying proportional relationships therein between, depending upon the volume of vessel fuel required, and the volume of each of the streams 35, 51*b*, 55 and 57 as described hereinabove. The skilled man can calculate optimal flows at each junction of disposition point, and calculate optimal flow rates in order to provide the required final vessel fuel stream 40*h*. Variance of the use and/or proportions of the vessel fuel streams 40, 46 could be operable using gates or valves 88.

Optionally, streams 33*b*, 38 are passed to the boil off gas stream 01. This will reduce the temperature of stream 35 to be more compatible with the requirements of the vessel fuel stream 40.

The person skilled in the art will understand that the invention can be carried out in many various ways without departing from the scope of the appended claims. For instance, the invention encompasses the combination of one or more of the optional or preferred features disclosed herein.

The invention claimed is:

1. A method of cooling a boil off gas (BOG) stream from a liquefied cargo in a floating transportation vessel, said liquefied cargo having a boiling point of greater than −110° C. at 1 atmosphere, said method comprising the steps of:

compressing a BOG stream from said liquefied cargo in at least two stages of compression comprising a first stage and a final stage to provide a compressed BOG discharge stream, wherein said first stage of compression has a first stage discharge pressure and said final stage of compression has a final stage suction pressure, and at least one intermediate compressed BOG streams is provided between consecutive stages of compression;

cooling the compressed BOG discharge stream against at least one first coolant streams to provide a first cooled compressed BOG stream;

cooling the first cooled compressed BOG stream against at least one second coolant stream to provide a second cooled compressed BOG stream;

cooling the second cooled compressed BOG stream against a third coolant stream to provide a third cooled compressed BOG stream;

providing a vessel fuel stream from the liquefied cargo;

using the vessel fuel stream as a coolant stream to cool both the compressed BOG discharge stream and the first cooled compressed BOG stream; and using at least an expanded portion of the third cooled compressed BOG stream as at least a portion of the vessel fuel stream.

2. The method according to claim 1 further comprising the steps of:

expanding a portion of the third cooled compressed BOG stream to a pressure between that of the first stage discharge pressure and the final stage suction pressure to provide a first expanded cooled BOG stream;

using the first expanded cooled BOG stream as the third coolant stream to provide a first expanded heated BOG stream; and using the first expanded heated BOG stream as the at least one second coolant stream.

3. The method according to claim 1 wherein the first cooled compressed BOG stream is cooled against the second coolant stream.

4. The method according to claim 1 wherein the second cooled compressed BOG stream is cooled against the third coolant stream.

5. The method according to claim 1 wherein of the second coolant stream comprises the first expanded heated BOG stream.

6. The method according to claim 1 further comprising the steps of:

providing a gaseous vent stream from the first cooled compressed BOG stream;

expanding a portion of the third cooled compressed BOG stream to form a fourth coolant stream; and cooling the gaseous vent stream against the fourth coolant stream to provide a cooled vent stream and a heated fourth coolant stream.

7. The method of claim 6 further comprising the step of using the heated fourth coolant stream as a BOG recycle stream.

8. The method according to claim 6 comprising the further steps of:

expanding the cooled vent stream to provide an expanded further cooled vent stream; and passing the expanded further cooled vent stream to a storage tank.

9. The method according to claim 6 comprising the further step of:

separating the further cooled vent stream to provide a vent discharge stream and a cooled vent BOG return stream.

10. The method according to claim 9 comprising the further steps of:

expanding the cooled vent BOG return stream to provide an expanded cooled vent BOG return stream; and passing the expanded cooled vent BOG return stream to a storage tank.

11. The method according to claim 10 wherein the fuel stream comprises both the expanded portion of the third cooled compressed BOG stream and at least a portion of the expanded portion of the cooled vent BOG return stream.

12. The method according to claim 6 further comprising the step of using at least an expanded portion of the gaseous vent stream, or at least an expanded portion of the vent discharge stream, or at least a portion of both said streams, as a vessel fuel stream.

13. The method according to claim 1 wherein the liquefied cargo is one of the group comprising: ethane, LPG, a liquefied petrochemical gas, and wherein the liquified petrochemical gas is one or more of propylene and ethylene, and ammonia.

14. The method according to claim 1 comprising at least three stages of compression.

15. The method according claim 1 wherein the step of using the vessel fuel stream as the coolant stream first cools the first cooled compressed BOG stream and then cools the compressed BOG discharge stream.

16. The method according to claim 1 wherein the step of cooling the compressed BOG discharge stream against one or more first coolant streams to provide a first cooled compressed BOG stream comprises the steps of:

pre-cooling the compressed BOG discharge stream against a pre-cooling coolant stream as a first coolant stream to provide a pre-cooled compressed BOG stream; and cooling the pre-cooled compressed BOG stream against a first refrigerant stream as a first coolant stream to provide the first cooled compressed BOG stream.

17. The method according to claim 16 wherein the pre-cooling coolant stream is one or more of the group selected from: seawater stream, an air stream, more particularly an ambient air stream and/or a refrigerant stream.

18. The method according to claim 16 wherein the first refrigerant stream is one or more of the group selected from propane and propylene.

19. The method according to claim 1 wherein the at least two stages of compression are performed in a multi-stage compressor.

* * * * *